US010490922B2

(12) United States Patent
Takase et al.

(10) Patent No.: US 10,490,922 B2
(45) Date of Patent: Nov. 26, 2019

(54) FLAT ELECTRIC CABLE CONNECTION STRUCTURE

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Shinichi Takase, Mie (JP); Yasuhiko Kotera, Mie (JP)

(73) Assignees: AutoNetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 16/098,529

(22) PCT Filed: Apr. 27, 2017

(86) PCT No.: PCT/JP2017/016671
§ 371 (c)(1),
(2) Date: Nov. 2, 2018

(87) PCT Pub. No.: WO2017/195617
PCT Pub. Date: Nov. 16, 2017

(65) Prior Publication Data

US 2019/0148857 A1 May 16, 2019

(30) Foreign Application Priority Data

May 11, 2016 (JP) ..... 2016-095353

(51) Int. Cl.
*H01R 12/77* (2011.01)
*H01B 7/08* (2006.01)
(Continued)

(52) U.S. Cl.
CPC ..... *H01R 12/772* (2013.01); *H01B 7/08* (2013.01); *H01R 12/78* (2013.01); *H01R 13/42* (2013.01);
(Continued)

(58) Field of Classification Search
CPC .. H01R 13/5833; H01R 13/58; H01R 13/506; H01R 13/42; H01R 13/5829;
(Continued)

(56) References Cited

U.S. PATENT DOCUMENTS 6,422,896 B2 * 7/2002 Aoki ..... H01R 12/592 439/456
2001/0019917 A1 * 9/2001 Sato ..... H01R 13/415 439/459
(Continued)

FOREIGN PATENT DOCUMENTS

JP 11-329620 A 11/1999
JP 2002-100426 A 4/2002
JP 2013-020800 A 1/2013

OTHER PUBLICATIONS

International Search Report dated Jul. 18, 2017 for WO 2017/195617 A1.

*Primary Examiner* — Gary F Paumen
(74) *Attorney, Agent, or Firm* — Abelman, Frayne & Schwab

(57) ABSTRACT

A flat electric cable connection structure includes a flat electric cable, terminal fittings, and alleviation portions. The flat electric cable includes, at one end portion thereof, a plurality of separate strip-shaped portions in which a plurality of band-shaped conductor paths are individually separated. The terminal fittings include conductor path connecting portions connected to band-shaped conductor paths of the separate band-shaped portions. The alleviation portions include bypass mechanisms that bypass an arrangement
(Continued)

route of the flat electric cable from the conductor path connecting portions of the terminal fittings to a lead-out portion.

3 Claims, 19 Drawing Sheets

(51) Int. Cl.
*H01R 12/78* (2011.01)
*H01R 13/42* (2006.01)
*H01R 13/58* (2006.01)
*H01R 13/422* (2006.01)

(52) U.S. Cl.
CPC ..... *H01R 13/5829* (2013.01); *H01R 13/422* (2013.01)

(58) Field of Classification Search
CPC .... H01R 13/422; H01R 12/772; H01R 12/78; H01B 7/08
USPC ..... 439/456, 459
See application file for complete search history.

(56) References Cited

U.S. PATENT DOCUMENTS

2002/0146932 A1 10/2002 Yamatani et al.
2014/0377987 A1* 12/2014 Germain ..... H01R 13/60 439/532

* cited by examiner

10A

FLAT ELECTRIC CABLE CONNECTION STRUCTURE

CROSS REFERENCE TO RELATED APPLICATIONS

This application is a national phase of PCT application No. PCT/JP2017/016671, filed on 27 Apr. 2017, which claims priority from Japanese Patent Application No. 2016-095353, filed on 11 May 2016, all of which are incorporated herein by reference.

TECHNICAL FIELD

The present invention relates to a connection structure of a flat electric cable, and specifically to a connection structure between a flat electric cable and terminal fittings that is used when the flat electric cable is mounted in a connector housing.

BACKGROUND

As for a connection structure between a flat electric cable and terminal fittings that is used when the flat electric cable is mounted in a connector housing, for example, the structure described in Patent Document 1 has conventionally been known. Patent Document 1 discloses a flat harness that includes a connector housing in which a plurality of terminal accommodation rooms accommodating terminal fittings are aligned in a width direction of a circuit structure (a flat electric cable) and provided in a plurality of levels. Since such a connector housing is provided, the flat harness is reduced in size.

PRIOR ART DOCUMENT

Patent Document

Patent Document 1: Japanese Patent Laid-Open Publication No. 2013-20800

SUMMARY OF THE INVENTION

Problem to be Solved

However, in a case where the flat electric cable is a flat electric cable having flexibility, such as a flexible printed circuit board (FPC), a reinforcing plate may be provided in the flat electric cable so that when the terminal fittings connected to a conductive line of the flat electric cable are inserted into the terminal accommodation rooms, an insertion operation can be stably performed. When such a reinforcing plate is provided, the insertion operation can be stably performed. However, depending on the configuration of the reinforcing plate, it may be assumed that a stress acts on a connecting portion between the conductive line (strip-shaped conductor path) of the flat electric cable and the terminal fittings from the reinforcing plate. When the stress acts on the connecting portion, a reliability of the connecting portion may be reduced.

As disclosed in Patent Document 1, in a configuration where the conductive line of the flat electric cable is split at a distal end thereof, and a branching portion (a separate band-shaped portion) is connected to the terminal fittings, a stress may concentrate on a specific separate band-shaped portion depending on a situation where the stress is applied.

Thus, it is desirable to suppress an action of the stress applied to the terminal fittings via the flat electric cable.

The technology disclosed in the present specification has been made based on the above described circumstances, and provides a flat electric cable connection structure capable of maintaining a connecting reliability of the separate band-shaped portion and the terminal fittings, even when the external force acts on the terminal fittings via the flat electric cable.

Means to Solve the Problem

A flat electric cable connection structure disclosed in the present specification includes: a flat electric cable including a plurality of band-shaped conductor paths wired in parallel at intervals, and an insulating resin that covers each of the band-shaped conductor paths; a lead-out portion configured to lead out the flat electric cable to outside; a plurality of terminal fittings individually connected to the band-shaped conductor paths, respectively; a connector housing configured to accommodate the plurality of terminal fittings; and an alleviation portion provided at a rear end portion of the connector housing, and configured to alleviate an external force acting on the terminal fittings through the flat electric cable. The flat electric cable includes, at one end portion thereof, a plurality of separate band-shaped portions in which the plurality of band-shaped conductor paths are individually separated, each of the separate band-shaped portions including each of the band-shaped conductor paths and the insulating resin, the terminal fittings include conductor path connecting portions, respectively, connected to the band-shaped conductor paths of the separate band-shaped portions, and the alleviation portion includes a bypass mechanism configured to bypass the arrangement route of the flat electric cable that extends from the conductor path connecting portions of the terminal fittings to the lead-out portion.

According to the configuration, due to the bypass mechanism that bypasses the arrangement route of the flat electric cable that extends from the conductor path connecting portions of the terminal fittings to the lead-out portion, the external force acting on the terminal fittings can be alleviated. For example, the external force acting on the terminal fittings can be alleviated by the bypass mechanism that bypasses the arrangement route by coming in contact with the flat electric cable and changing the extending direction of the flat electric cable. That is, in such a case, the external force acts on an electric cable contact portion of the bypass mechanism at first. Thus, as compared to a case where the external force acts directly on the terminal fittings, the external force acting on the terminal fittings can be reduced because the external force acts on the bypass mechanism at first. As a result, the connecting reliability of the separate band-shaped portions and the terminal fittings can be maintained, even when the external force acts on the terminal fittings via the flat electric cable.

The flat electric cable connection structure includes a first holding portion and a second holding portion constituting the alleviation portion and locked to the rear end portion of the connector housing. The first holding portion is locked to a lower portion of the rear end portion of the connector housing, and includes: a first upper plate portion serving as the bypass mechanism that allows the flat electric cable to be placed thereon, and changes an extending direction of the flat electric cable to a first change direction at an end portion of the extending direction of the flat electric cable; a first lower plate portion that clamps the flat electric cable together with the second holding portion; and a coupling portion that is coupled with the second holding portion. The second holding portion includes: a second upper plate portion that clamps the flat electric cable together with the first upper plate portion; and a second lower plate portion serving as the bypass mechanism that changes the first change direction to a second change direction at an end portion of the first change direction, and clamps the flat electric cable in the second change direction, together with the first lower plate portion.

According to this configuration, the extending direction of the flat electric cable is changed twice by the first upper plate portion of the first holding portion and the second lower plate portion of the second holding portion. Accordingly, the external force acting on the terminal fittings can be reliably reduced.

In the flat electric cable connection structure, the second holding portion includes a rear wall portion serving as the bypass mechanism that forms, together with the first upper plate portion, a deflection space in which the flat electric cable is deflected.

According to this configuration, due to the deflection space, the deflection as a bypass of the arrangement route is formed in the flat electric cable. Thus, the action of the external force can be absorbed by the deflection of the flat electric cable, and thus reduced. Accordingly, the external force acting on the terminal fittings can be further reduced.

In the flat electric cable connection structure, the flat electric cable includes a reinforcing plate at a portion clamped between the first lower plate portion and the second lower plate portion.

According to this configuration, a clamping force on the flat electric cable, which is applied by the first lower plate portion and the second lower plate portion, can be reinforced by the reinforcing plate. Thus, the action of the external force can be absorbed and reduced. Accordingly, the external force acting on the terminal fittings can be further reduced.

The flat electric cable connection structure includes a first holding portion and a second holding portion constituting the alleviation portion and locked to the rear end portion of the connector housing. The first holding portion is locked to a lower portion of the rear end portion of the connector housing, and includes: a body portion serving as the bypass mechanism that forms a deflection space in which the flat electric cable is deflected; and a locked portion locked to the second holding portion. The second holding portion includes: a platy portion serving as the bypass mechanism that clamps the flat electric cable by the body portion in a state where the flat electric cable is deflected; and a locking portion formed on the platy portion and locked to the locked portion of the first holding portion.

According to this configuration, due to the bypass mechanism, the deflection as a bypass of the arrangement route is formed in the flat electric cable in the deflection space. Thus, the action of the external force can be absorbed by the deflection formed in the flat electric cable, and thus reduced. Accordingly, the external force acting on the terminal fittings can be reliably reduced.

In the flat electric cable connection structure, the flat electric cable includes an engaged portion engaged with the first holding portion at a position on a side of the lead-out portion rather than a forming location of a deflection of the flat electric cable, and the first holding portion includes an engaging portion engaged with the engaged portion of the flat electric cable and locked to the flat electric cable.

According to this configuration, the flat electric cable is fixed by the engaging portion at a position on the side of the lead-out portion rather than the forming location of the deflection of the flat electric cable. This can reduce the external force acting on the deflection of the flat electric cable. Thus, the external force acting on the terminal fittings can be further reduced.

In the flat electric cable connection structure, the engaged portion of the flat electric cable is constituted by a through hole, the engaging portion of the first holding portion is constituted by a columnar portion inserted into the through hole, and the body portion and the platy portion clamp the flat electric cable at a portion extending from the through hole of the flat electric cable.

According to this configuration, the columnar portion is inserted into the through hole of the flat electric cable so that the flat electric cable is reliably held by the first holding portion. A portion extending from the through hole of the flat electric cable is clamped between the body portion of the first holding portion and the platy portion of the second holding portion. Thus, the action of the external force on the deflection in the flat electric cable is reduced, and thus, the external force acting on the terminal fittings can be further reduced

Effect of the Invention

According to the flat electric cable connection structure disclosed in the present specification, the connecting reliability of the band-shaped conductor paths of the flat electric cable and the terminal fittings can be maintained even when a reinforcing plate is provided in the flat electric cable.

DETAILED DESCRIPTION TO EXECUTE THE INVENTION

<First Embodiment>

A first embodiment according to the present invention will be described with reference to FIGS. 1 to 14.

1. Configuration of Flat Electric Cable Connection Structure

Figure 1:
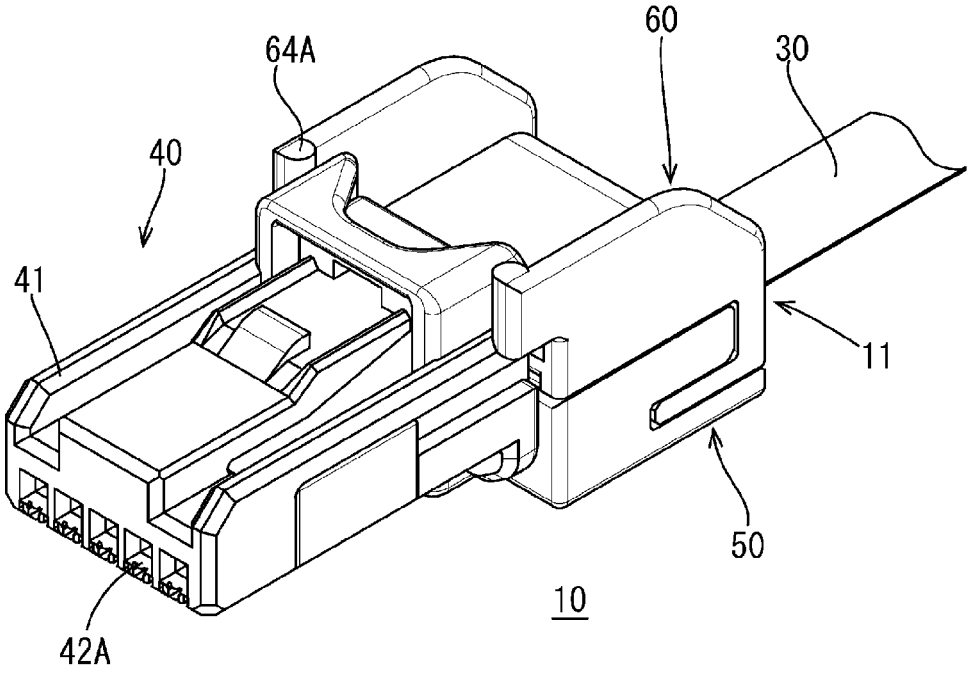
FIG. 1 is a front perspective view of a flat electric cable connection structure according to a first embodiment.

The present embodiment corresponds to an example of a case where a flat electric cable connection structure 10 is applied to a voltage detection line connected between a battery (not illustrated) and a control unit. The flat electric cable connection structure 10, as illustrated in FIG. 1, includes terminal fittings 20 (see FIG. 3), a flat electric cable 30, a connector housing 40, a first holding portion 50, and a second holding portion 60. In the following description, in the longitudinal direction of the flat electric cable 30, the connector housing 40 side will be referred to as a front side, and the other side will be referred to as a rear side, and the same direction as the width direction of the flat electric cable 30 will be referred to as a width direction of the connector housing 40.

The connector housing 40, as illustrated In FIGS. 1 to 4, is formed in a block shape, is made of a synthetic resin, and includes a housing body 41 and a plurality of cavities 42 (corresponding to terminal accommodation rooms).

Through the housing body 41, the plurality of cavities 42 capable of accommodating the terminal fittings 20 from the rear side thereof are formed in the front-rear direction. As for the cavities 42, five rooms are arranged in parallel in the width direction in the present embodiment, and each front end thereof is formed as an insertion hole 42A through which a male terminal fitting held by a mating connector is inserted. At the rear end of the housing body 41, a first engaged portion 43 (see FIG. 3) to be engaged with an engaging claw 54A of the first holding portion 50 that holds the flat electric cable 30, and second engaged portions 44 (see FIG. 2) to be engaged with engaging portions 64A of the second holding portion 60 are provided.

Each of the terminal fittings 20 accommodated within the cavities 42 is a female terminal fitting obtained through, for example, a press molding of a metal plate material. The terminal fitting 20, as illustrated in, for example, FIG. 9, includes a square-tubular terminal connecting portion 21, and a flat plate-shaped conductor path connecting portion 22 extending rearward from the rear end of the terminal connecting portion 21. The conductor path connecting portion 22 is bonded to an exposed band-shaped conductor path 31A of the flat electric cable 30 as described below by solder.

Figure 3:
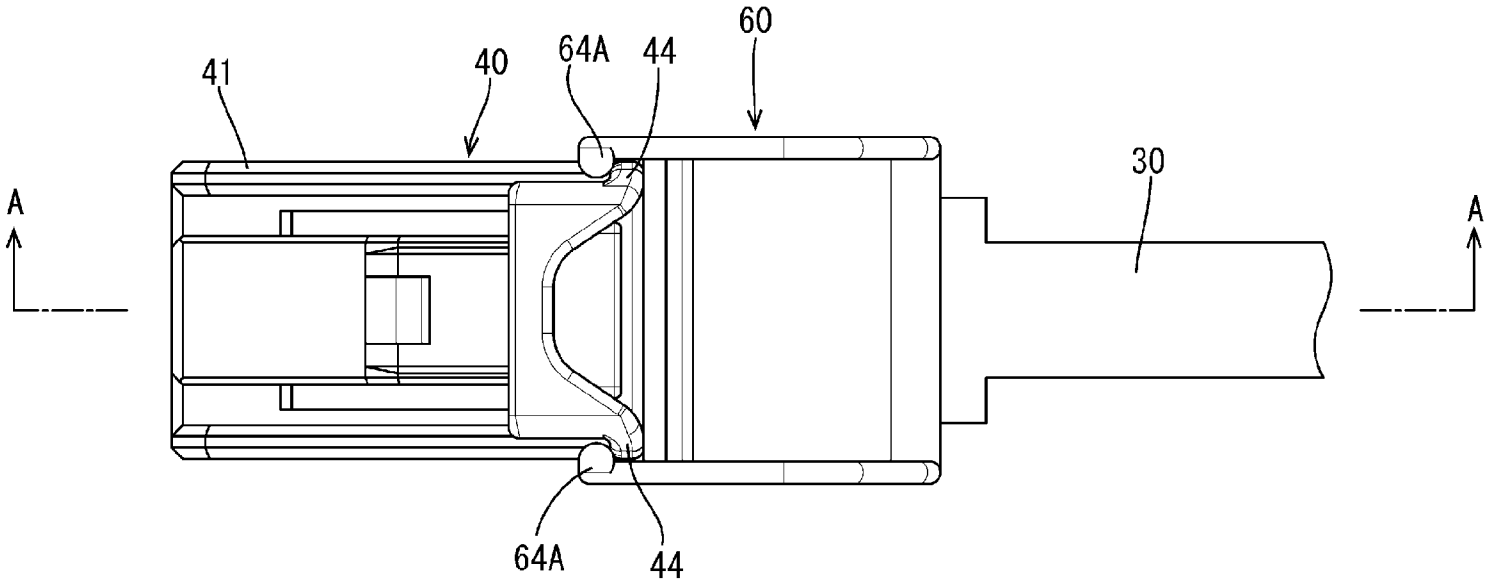
FIG. 3 is a plan view of the flat electric cable connection structure.

The first holding portion 50 and the second holding portion 60 are made of a synthetic resin, and mounted at the rear end of the housing body 41 through the first engaged portion 43 and the second engaged portions 44 as illustrated in FIGS. 1 and 3. Here, the first holding portion 50 and the second holding portion 60 are coupled with each other while clamping the flat electric cable 30 therebetween so as to hold the flat electric cable 30.

Figure 4:
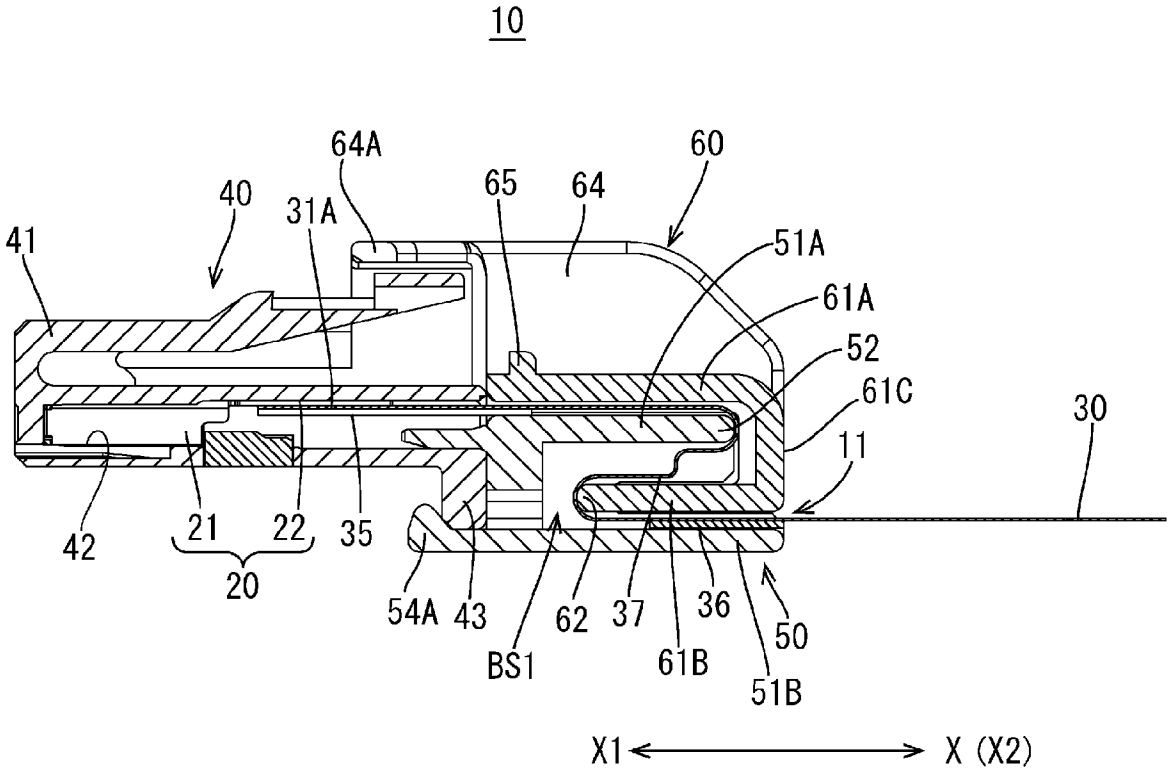
FIG. 4 is a sectional view taken along the line A-A in FIG. 3.
Figure 7:
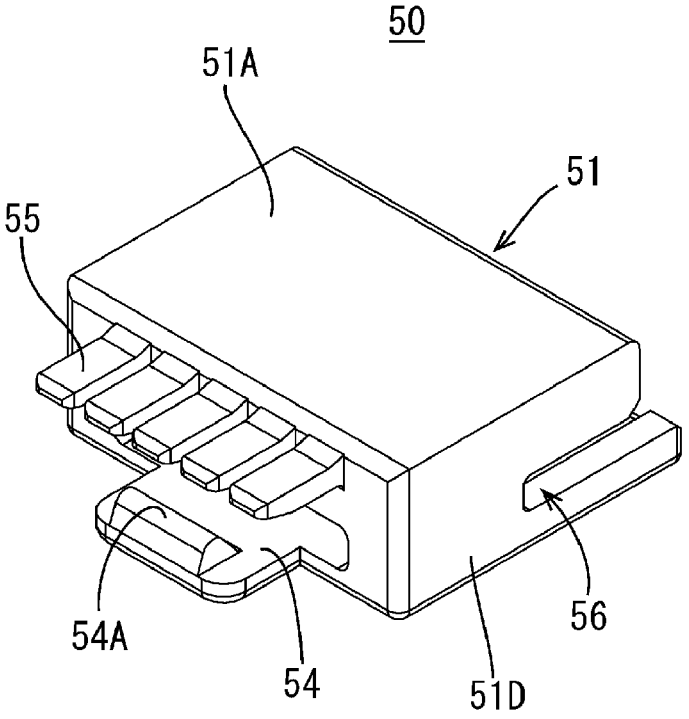
FIG. 7 is a perspective view of a first holding portion in the first embodiment.

The first holding portion 50, as illustrated in FIG. 4, is locked to the lower portion of the rear end portion of the connector housing 40. The first holding portion 50, as illustrated in FIG. 7, includes a body portion 51, a first upper plate portion 51A, a first lower plate portion 51B, a pair of side wall portions 51D, and a pair of first cut-out portions 56. The first cut-out portion 56 is an example of a coupling portion.

The first upper plate portion 51A is located on the top portion of the body portion 51, allows the flat electric cable 30 to be placed thereon, and changes the extending direction of the flat electric cable to a first change direction (the arrow X1 direction) as a reverse direction (see FIG. 13) at an end portion 52 in the extending direction (the arrow X direction) of the flat electric cable. In the present embodiment, as illustrated in FIG. 4, the extending direction is changed to the first change direction by approximately 180 degrees. That is, the extending direction and the first change direction are directed in substantially opposite directions to each other. The first upper plate portion 51A is an example of a bypass mechanism that bypasses an arrangement route of the flat electric cable 30 that extends from the conductor path connecting portions 22 of the terminal fittings 20 to a lead-out portion 11.

The first lower plate portion 51B clamps the flat electric cable 30, together with the second holding portion 60, specifically, together with a second lower plate portion 61B of the second holding portion 60 as described below. The first cut-out portion 56 is formed in each side wall portion 51D, and is coupled with the second holding portion 60, specifically, with a portion 64B of a side wall portion 64 of the second holding portion 60 as described below. A part of the side wall portion 51D is coupled with a second cut-out portion 66 of the second holding portion 60 as described below. That is, a part of the side wall of each of the first holding portion 50 and the second holding portion 60 is inserted into and coupled with the cut-out portion at the mating side so that the first holding portion 50 is coupled with the second holding portion 60.

In the first holding portion 50, an engaging piece 54 and clamping pieces 55 are provided to couple with the housing body 41. The engaging claw 54A is provided on the engaging piece 54, and the engaging claw 54A is engaged with the first engaged portion 43 of the housing body 41. The clamping pieces 55 are provided corresponding to the cavities 42, respectively, and clamp the first engaged portion 43, together with the engaging piece 54.

Figure 8:
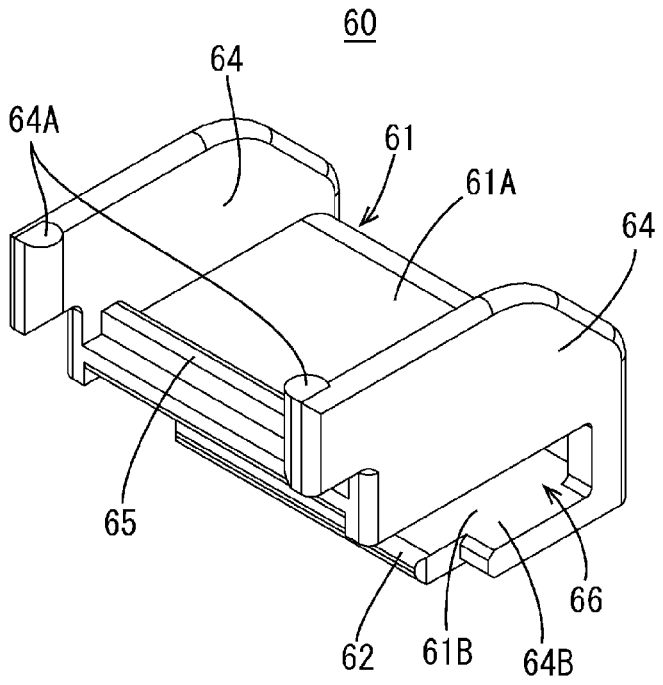
FIG. 8 is a perspective view of a second holding portion in the first embodiment.

The second holding portion 60, as illustrated in FIG. 4, is provided on the top portion of the first holding portion 50 and locked to the rear end portion of the connector housing 40. The second holding portion 60, as illustrated in FIG. 8, includes a body portion 61, a second upper plate portion 61A, the second lower plate portion 61B, a rear wall portion 61C, a pair of side wall portions 64, a rib portion 65, and the second cut-out portion 66.

The second upper plate portion 61A clamps the flat electric cable 30 at the lower portion thereof, together with the first upper plate portion 51A of the first holding portion 50.

The second lower plate portion 61B changes the first change direction to a second change direction (the arrow X2 direction in FIG. 4) as a reverse direction at an end portion 62 of the first change direction (the arrow X1 direction in FIG. 4). In the present embodiment, as illustrated in FIG. 4, the first change direction is changed to the second change direction by approximately 180 degrees. That is, the first change direction and the second change direction become substantially opposite directions. Thus, the first extending direction (the arrow X direction in FIG. 4) of the flat electric cable 30 becomes same as the second change direction. Similarly to the first upper plate portion 51A, the second lower plate portion 61B is an example of a bypass mechanism.

The manner in which the extending direction of the flat electric cable is changed by the first upper plate portion 51A and the second lower plate portion 61B is not limited thereto. For example, each extending direction of the flat electric cable may be changed by 90 degrees, or changed by 135 degrees. Alternatively, the changing angles may be different.

The second lower plate portion 61B clamps the flat electric cable 30 extending in the second change direction, together with the first lower plate portion 51B of the first holding portion 50. The flat electric cable 30 is led out to the outside from a clamping portion between the rear end portion of the first lower plate portion 51B and the rear end portion of the second lower plate portion 61B so that the lead-out portion 11 of the flat electric cable 30 is formed by the same clamping portion.

The second cut-out portion 66 is formed in each side wall portion 64 to couple with the first holding portion 50, specifically, a part of the side wall portion 51D of the first holding portion 50. The portion 64B of the second lower plate portion 61B corresponding to the side wall portion 64 couples with the first cut-out portion 56 of the first holding portion 50. Accordingly, the first holding portion 50 and the second holding portion are coupled with each other.

The rear wall portion 61C, together with the first upper plate portion 51A, as illustrated in FIG. 4, deflects the flat electric cable 30, that is, forms a deflection space BS1 that bypasses the flat electric cable 30. The rear wall portion 61C is an example of a bypass mechanism. In this manner, the formed deflection space BS1 provides a deflection 37 to the flat electric cable 30 so that an action of the external force can be absorbed by the deflection 37 of the flat electric cable and the action of the external force can be reduced. Therefore, the external force acting on the terminal fittings 20 can be reduced.

In the second holding portion 60, the engaging portion 64A to be coupled with the housing body 41 is provided at the distal end portion of each side wall portion 64. The engaging portion 64A is engaged with the second engaged portion 44 of the housing body 41. The rib portion 65 reinforces the coupling between the second holding portion 60 and the housing body 41.

With the configuration discussed above, the first holding portion 50 and the second holding portion 60 are provided at the rear end portion of the connector housing 40 to constitute an alleviation portion that alleviates the external force acting on the terminal fittings 20 through the flat electric cable 30.

The flat electric cable 30 is constituted by a flexible printed circuit board (FPC) in the present embodiment. The flat electric cable 30 is led out from the rear end of the connector housing 40, specifically, the lead-out portion 11 by the first and second holding portions 50 and 60, and has a similar function to a voltage detection line that connects a battery (not illustrated) to a control unit that controls the battery by band-shaped conductor paths 31 formed along the led-out (extending) direction.

Figure 5:
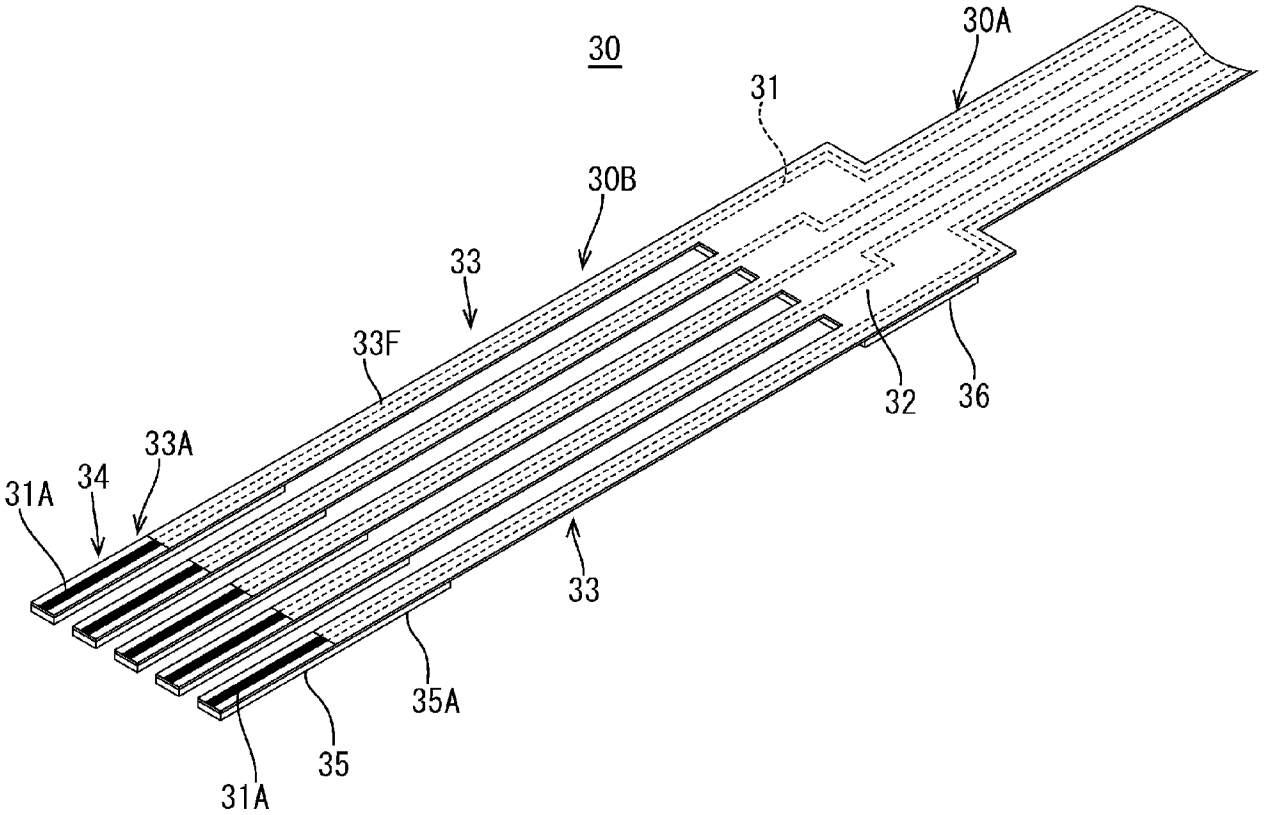
FIG. 5 is a perspective view of the flat electric cable.

The flat electric cable 30, as illustrated in FIG. 5, includes a plurality of band-shaped conductor paths 31 wired in parallel at intervals and an insulating resin film 32 that covers both surfaces of each of the band-shaped conductor paths 31. Each band-shaped conductor path 31 is formed of, for example, a copper foil. Both surfaces of each band-shaped conductor path 31 may not be covered with the insulating resin film 32. The insulating resin is not limited to a film-type insulating resin. For example, the insulating resin may be a sheet-type insulating resin thicker than a film, or may be an insulating resin coated on an insulating resin film serving as a substrate. The insulating resin film is an example of an insulating resin.

The flat electric cable 30, as illustrated in FIG. 5, includes an electric cable body portion 30A in which the plurality of band-shaped conductor paths 31 are integrally covered with the insulating resin film 32, and a plurality of separate band-shaped portions 33 in which the plurality of band-shaped conductor paths 31 are individually separated, at one end portion 30B thereof. In the present embodiment, a case where the number of band-shaped conductor paths 31 is five is illustrated, but the present invention is not limited thereto.

Each of the separate band-shaped portions 33 includes the band-shaped conductor path 31 and the insulating resin film 32. Each separate band-shaped portion 33, as illustrated in FIG. 5, includes an exposed portion 34 including the exposed band-shaped conductor path 31A, on a front surface 33F of a distal end portion 33A thereof. That is, in the exposed portion 34, the insulating resin film 32 is removed.

Figure 6:
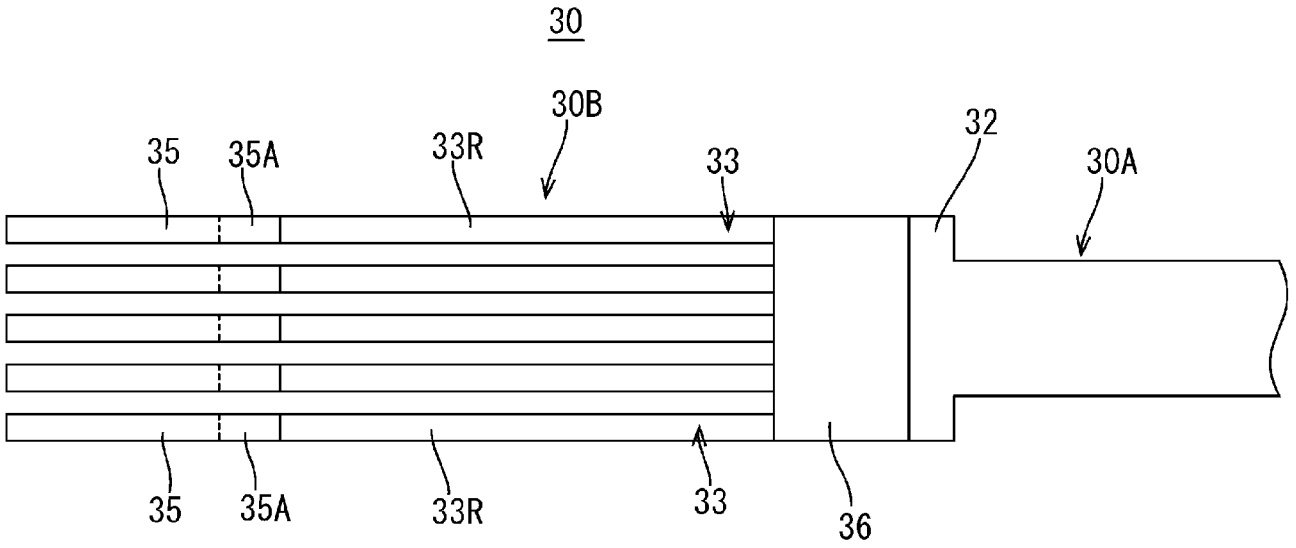
FIG. 6 is a rear view of the flat electric cable.

Meanwhile, on a back surface 33R of the distal end portion 33A of each separate band-shaped portion 33, as illustrated in FIG. 6, a distal end portion reinforcing plate 35 that reinforces the distal end portion 33A is provided to cover the back surface 33R of the distal end portion 33A in its entirety. The distal end portion reinforcing plate 35 is made of, for example, a glass epoxy resin, or a polyimide resin.

Figure 12:
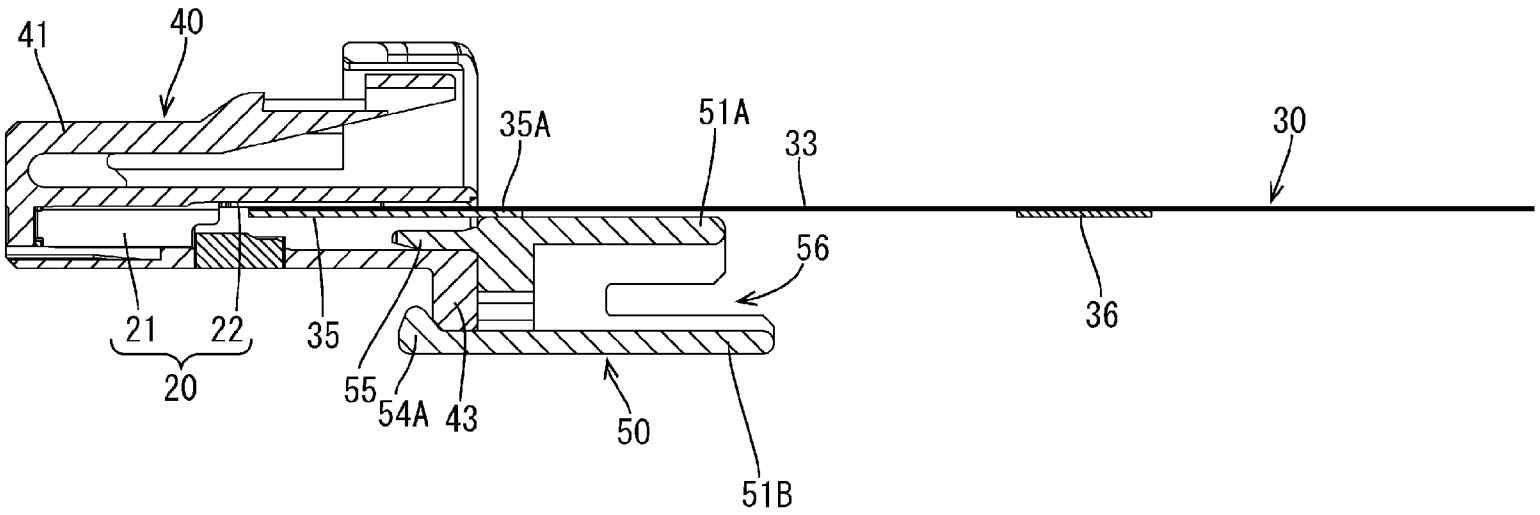
FIG. 12 is a sectional view taken along the line B-B in FIG. 11.

The distal end portion reinforcing plates 35, as illustrated in FIG. 6, include grip portions 35A that are exposed from the connector housing 40 and can be gripped together with the separate band-shaped portions 33 in a state where the terminal fittings 20 to which the band-shaped conductor paths 31 are connected are accommodated in the cavities 42 of the connector housing 40 (see, e.g., FIG. 12). That is, the distal end portion reinforcing plates 35 have a length in the longitudinal direction by which the distal end portion reinforcing plates 35 are exposed from the connector housing in a state where the terminal fittings 20 to which the band-shaped conductor paths 31 are connected are accommodated in the cavities 42.

A clamping portion reinforcing plate (an example of a "reinforcing plate") 36 having the same width as the flat electric cable 30 is provided on the back surface 33R of the electric cable body portion 30A of the flat electric cable 30. The clamping portion reinforcing plate 36, as illustrated in FIG. 4, is disposed at a portion where the flat electric cable 30 is clamped between the first lower plate portion 51B of the first holding portion 50 and the second lower plate portion 61B of the second holding portion 60.

2. Method of Assembling Flat Electric Cable Connection Structure

Figure 9:
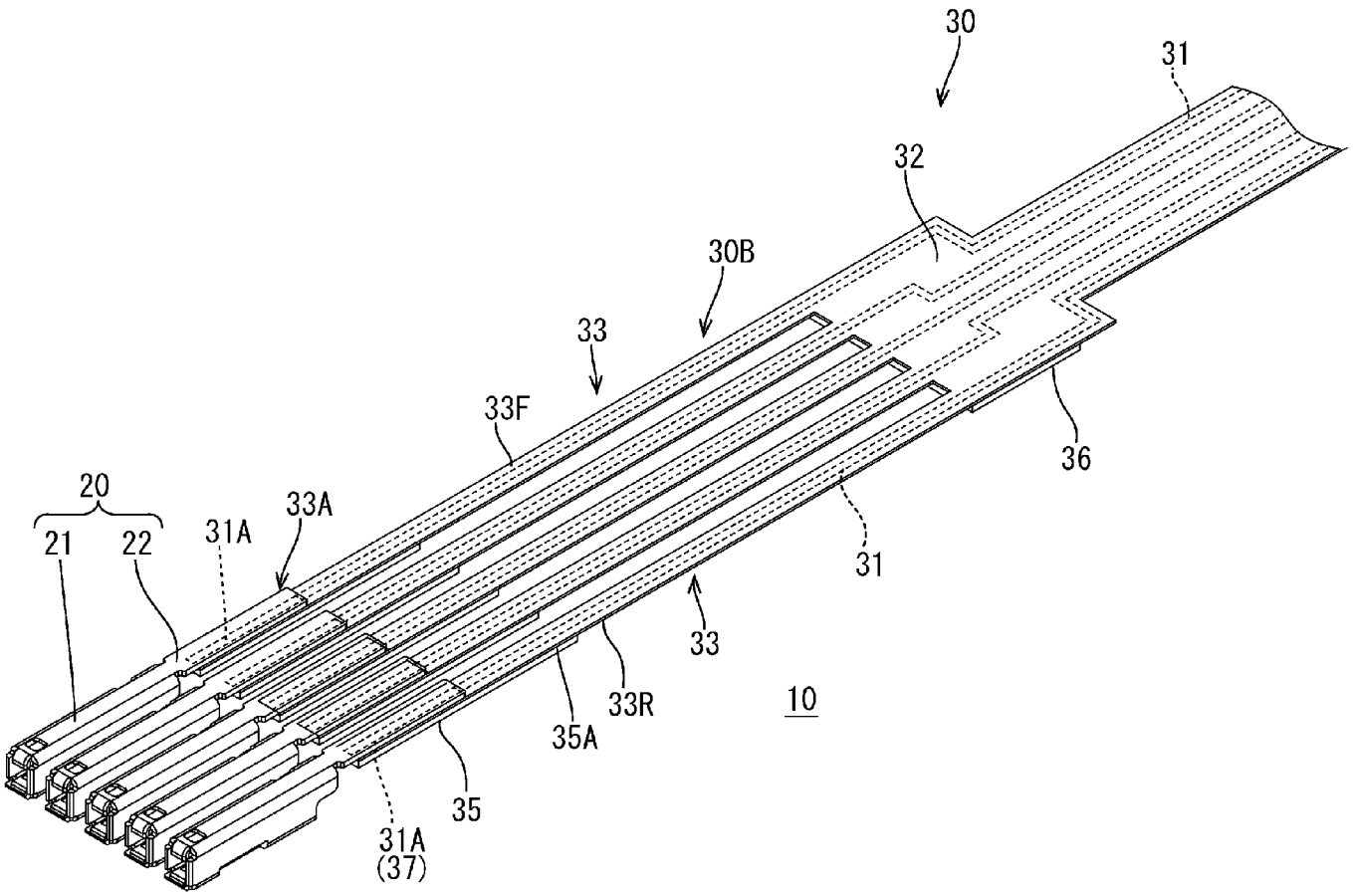
FIG. 9 is a perspective view illustrating a state where terminal fittings are connected to the flat electric cable.

First, the terminal fittings 20 are bonded to the flat electric cable 30 in a flat state as illustrated in FIGS. 4 and 5. Specifically, the conductor path connecting portions 22 of the terminal fittings 20 are bonded to the exposed band-shaped conductor paths 31A of the flat electric cable 30, respectively, by reflow solder. Then, as illustrated in FIG. 9, a connection structure between the terminal fittings 20 and the flat electric cable 30 is formed.

Figure 10:
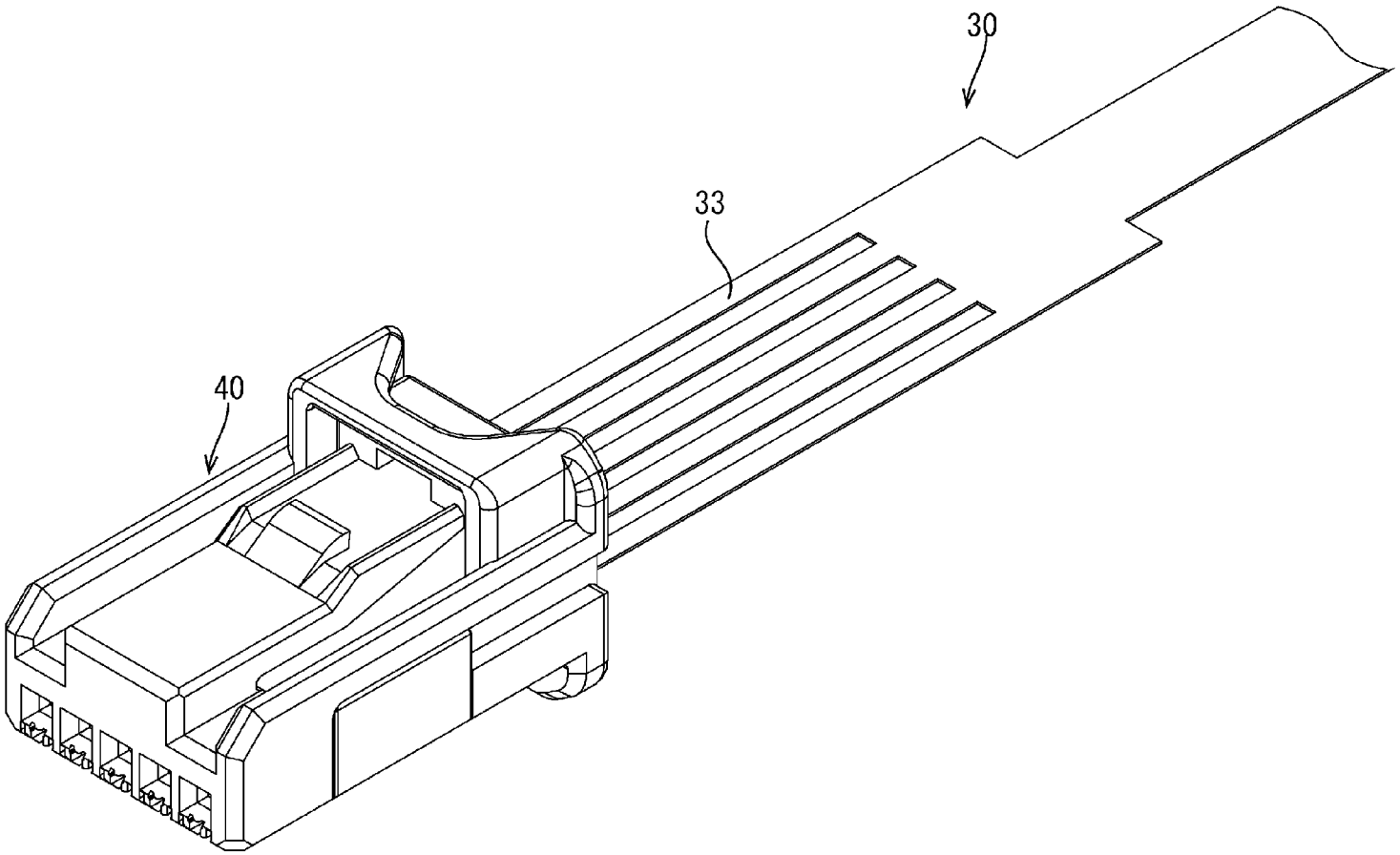
FIG. 10 is a perspective view illustrating a state where the flat electric cable is mounted in a connector housing.

Subsequently, the terminal fittings 20 bonded to the band-shaped conductor paths 31A are inserted into the cavities 42, respectively, from the rear side of the connector housing 40 such that each of the terminal fittings 20 is fixed to the connector housing 40. Here, the terminal fittings 20 are inserted into the cavities 42 while the grip portions 35A of the distal end portion reinforcing plates 35 are gripped together with the separate band-shaped portions 33. Accordingly, as illustrated in FIG. 10, the connection structure where the flat electric cable 30 in a flat state is mounted in the connector housing 40 is formed.

Figure 11:
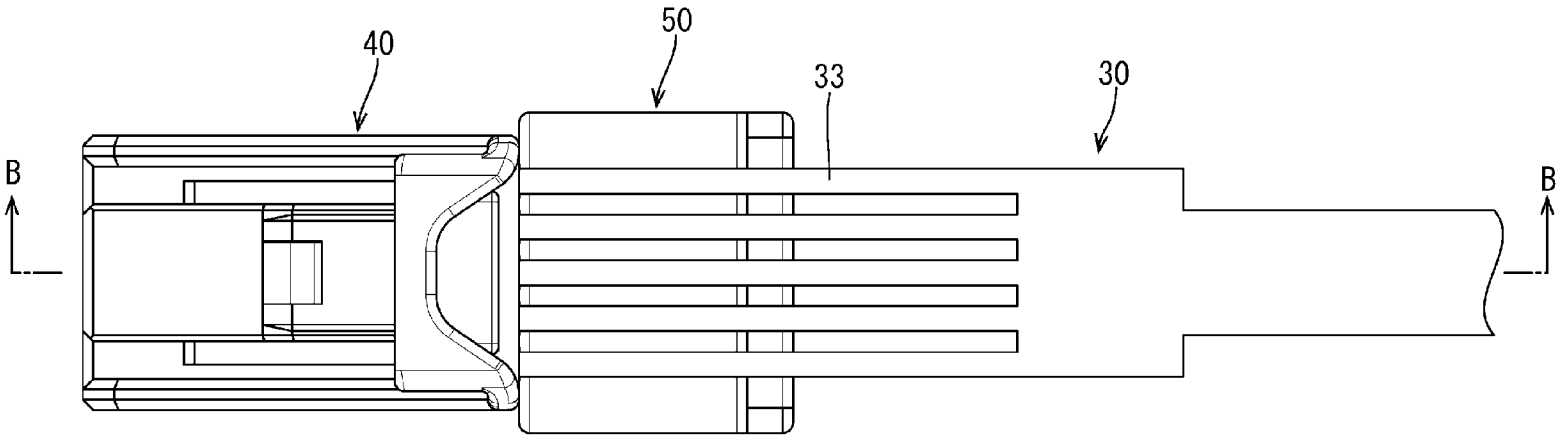
FIG. 11 is a plan view illustrating a state where the first holding portion is mounted to the connector housing.

Subsequently, as illustrated in FIGS. 11 and 12, the first engaged portion 43 of the housing body 41 is clamped between the engaging piece 54 and the clamping pieces 55 of the first holding portion 50 at the rear side of the connector housing 40 so that the first holding portion 50 is mounted at the rear lower portion of the connector housing 40.

Figure 13:
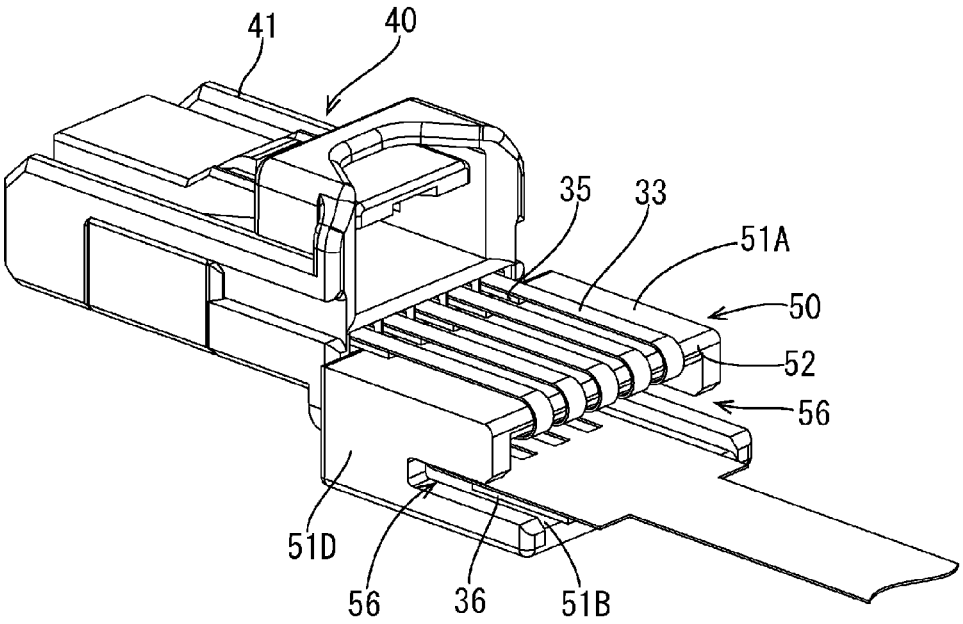
FIG. 13 is a perspective view illustrating a state where the flat electric cable is arranged in the first holding portion.
Figure 14:
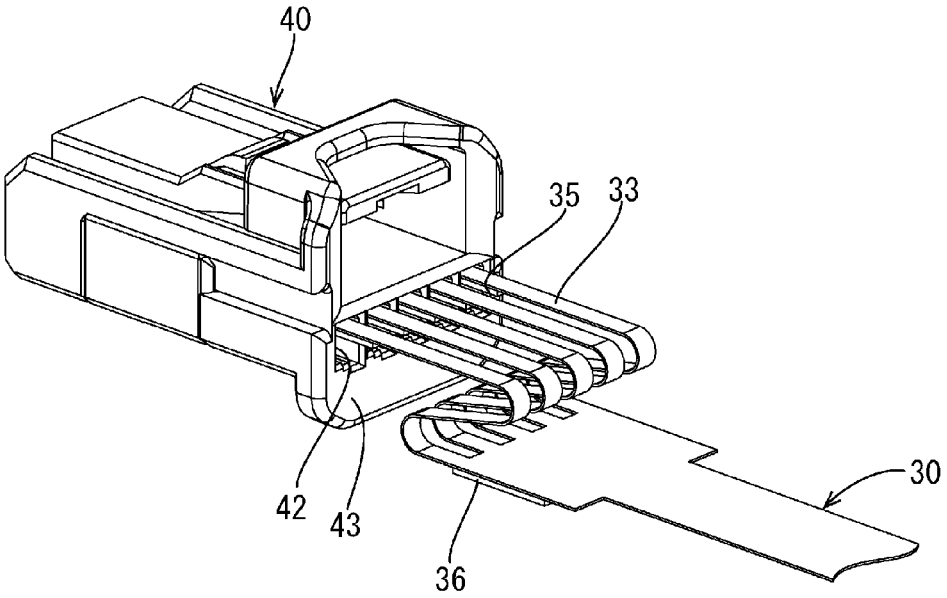
FIG. 14 is a perspective view illustrating a state of the flat electric cable in which the first holding portion in FIG. 13 is omitted.

Subsequently, each of the separate band-shaped portions 33 of the flat electric cable 30, as illustrated in FIGS. 13 and 14, is bent by using, for example, the end portion 52 of the first holding portion 50. That is, the extending direction of the flat electric cable 30 is changed.

Figure 2:
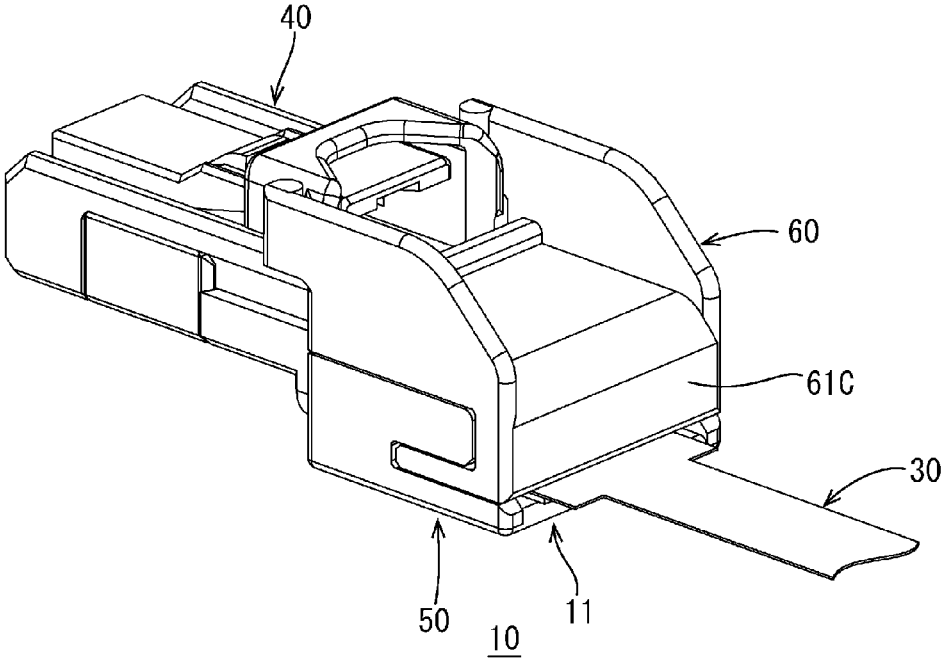
FIG. 2 is a rear perspective view of the flat electric cable connection structure.

Subsequently, the engaging portions 64A of the second holding portion 60 are engaged with the second engaged portions 44 of the housing body 41 from the rear side of the first holding portion 50 as illustrated in FIG. 13, so that the second holding portion 60 is mounted in the housing body 41. Here, each of the separate band-shaped portions 33 of the flat electric cable 30, as illustrated in FIG. 2, is clamped between the first holding portion 50 and the second holding portion 60, is bent at the end portion 52 of the first holding portion 50, and the end portion 62 of the second holding portion 60, by approximately 180 degrees, and is deflected in the deflection space BS1. At the lead-out portion 11, the flat electric cable 30 is clamped between the first holding portion 50 and the second holding portion 60 via the clamping portion reinforcing plate 36.

Accordingly, the assembly of the flat electric cable connection structure 10 as illustrated in FIGS. 1 and 4 is completed.

3. Effect of First Embodiment

In the first embodiment, the first upper plate portion 51A of the first holding portion 50, the second lower plate portion 61B of the second holding portion 60, and the rear wall portion 61C of the second holding portion 60 are provided as bypass mechanisms that bypass an arrangement route of the flat electric cable 30 from the conductor path connecting portions 22 of the terminal fittings 20 to the lead-out portion 11. By these bypass mechanisms, an external force acting on the terminal fittings can be alleviated. That is, in such a case, the external force acts on an electric cable contact portion of the bypass mechanism (the end portion 62 of the second lower plate portion 61B and the end portion 52 of the first upper plate portion 51A) for the first time. Thus, as compared to a case where the external force directly acts on the terminal fittings 20, the external force acting on the terminal fittings 20 can be reduced because the external force acts on the bypass mechanism for the first time. As a result, the connecting reliability of the separate strip-shaped portions 33 and the terminal fittings 20 can be maintained even when the external force acts on the terminal fittings 20 via the flat electric cable 30.

The extending direction of the flat electric cable 30 is changed twice by the first upper plate portion 51A of the first holding portion 50 and the second lower plate portion 61B of the second holding portion 60. That is, the external force is reduced twice. Accordingly, the external force acting on the terminal fittings 20 can be reliably reduced.

The deflection 37 is formed at the flat electric cable 30, specifically, each of the separate band-shaped portions 33 in the deflection space BS1 formed by the first upper plate portion 51A of the first holding portion 50 and the rear wall portion 61C of the second holding portion 60. Thus, the action of the external force can be absorbed by extending the deflection 37. Accordingly, the external force acting on the terminal fittings 20 can be further reduced.

The clamping portion reinforcing plate 36 is provided at a portion of the flat electric cable 30 clamped between the first lower plate portion 51B of the first holding portion 50 and the second lower plate portion 61B of the second holding portion 60. Thus, a clamping force on the flat electric cable 30, which is applied by the first lower plate portion MB and the second lower plate portion 61B, can be reinforced by the clamping portion reinforcing plate 36. The action of the external force can be absorbed by the clamping force and then reduced. Then the external force acting on the terminal fittings 20 can be further reduced.

<Second Embodiment>

Thereafter, a second embodiment will be described with reference to FIGS. 15 to 19. Only configurations different from those in the first embodiment will be described, and the same configurations as those in the first embodiment will be denoted by the same reference numerals and descriptions thereof will be omitted.

Figure 15:
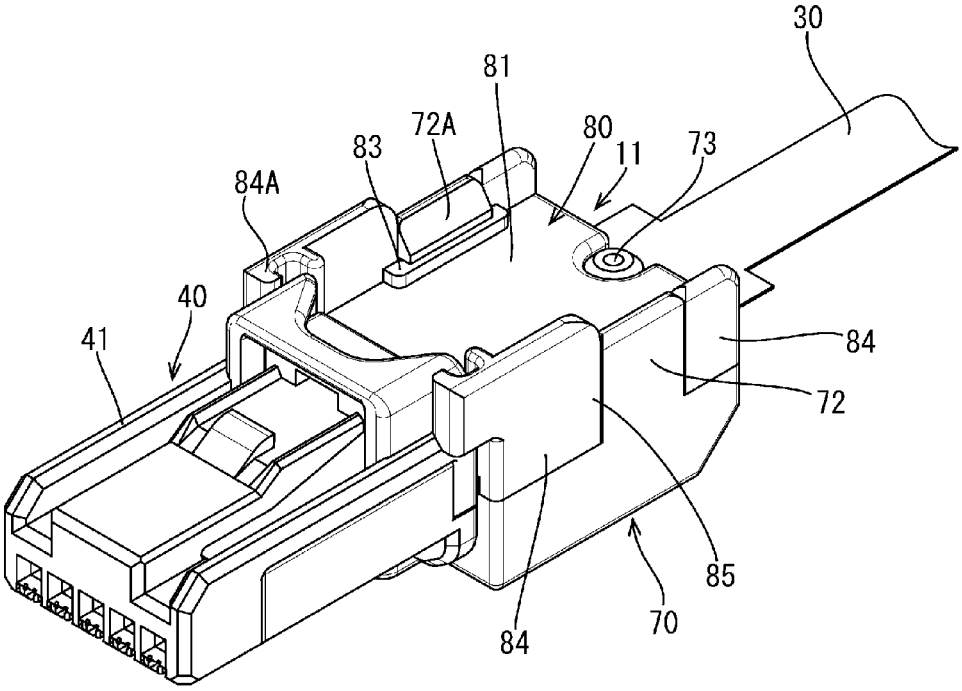
FIG. 15 is a perspective view of a flat electric cable connection structure according to a second embodiment.

The configuration of a flat electric cable connection structure 10A of the second embodiment as illustrated in FIG. 15 is different from that in the first embodiment in the configuration of an alleviation portion. That is, the alleviation portion in the first embodiment is constituted by the first holding portion 50 and the second holding portion 60, whereas the alleviation portion in the second embodiment is constituted by a first holding portion 70, a second holding portion 80, and a through hole 38 formed in the flat electric cable 30.

As in the first holding portion 50 of the first embodiment, the first holding portion 70 in the second embodiment, as illustrated in FIG. 15, is locked to the lower portion of the rear end portion of the connector housing 40. The first holding portion 70, as illustrated in FIG. 16, includes a body portion 71, a pair of locked portions 72, an engaging portion 73, an engaging piece 74, and clamping pieces 75.

The body portion 71 includes a peripheral wall 71A that forms a deflection space BS2 that deflects the flat electric cable 30. Each of the locked portions 72 is provided to protrude upward from the peripheral wall 71A at a lateral side thereof, and has a claw portion 72A at the distal end portion thereof. The claw portion 72A is locked to the second holding portion 80.

Figure 16:
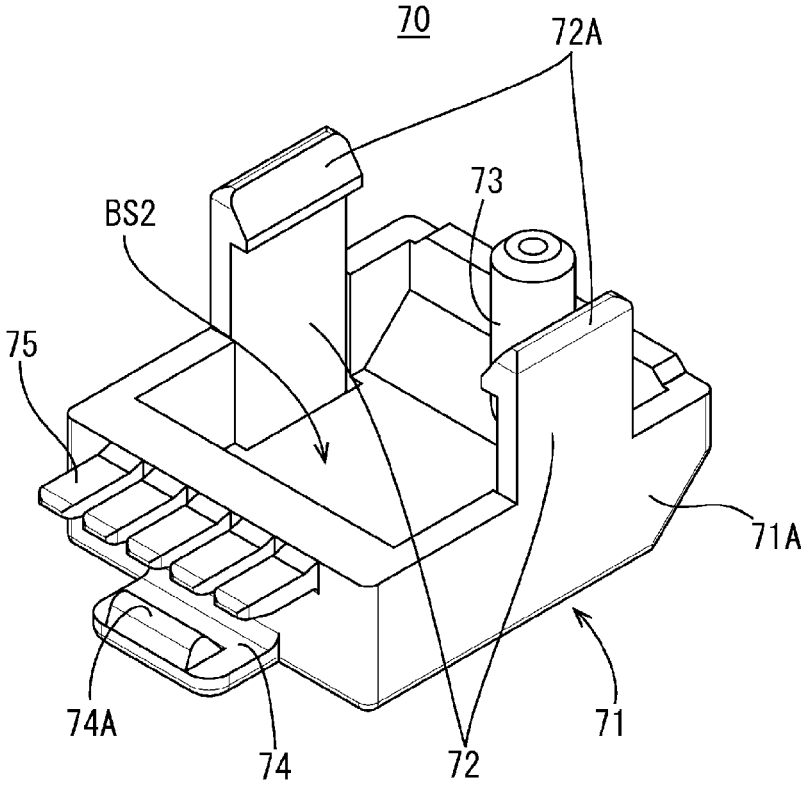
FIG. 16 is a perspective view of a first holding portion in the second embodiment.
Figure 19:
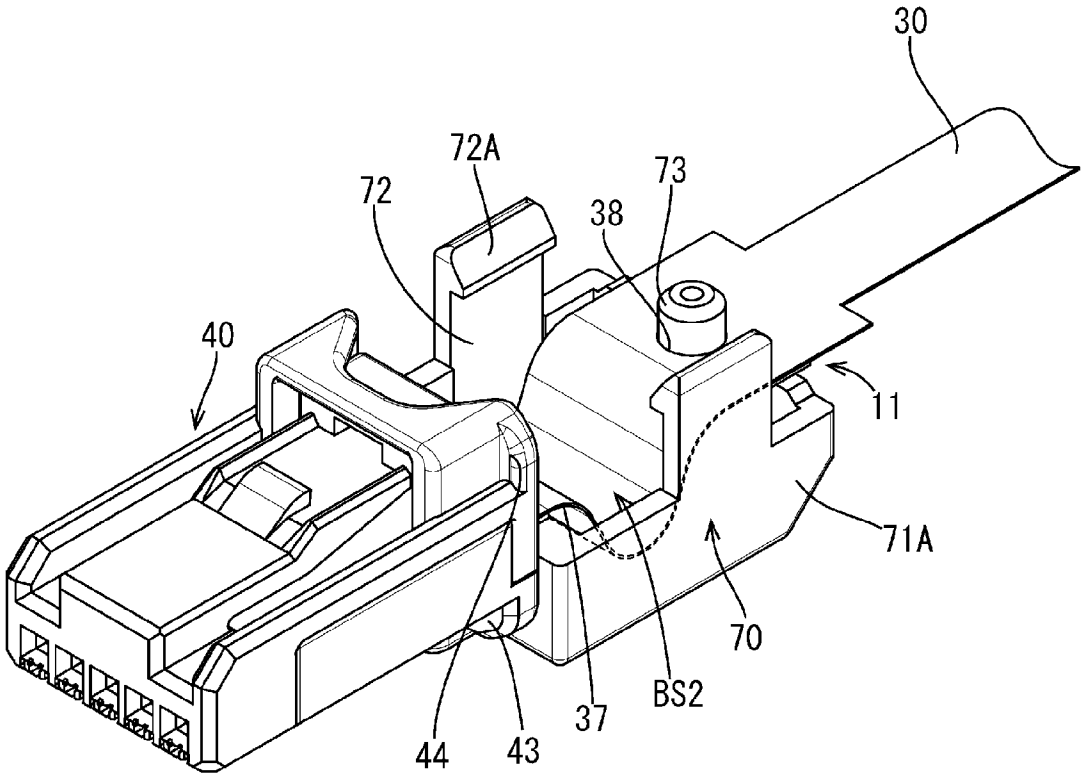
FIG. 19 is a perspective view illustrating a state where the flat electric cable and the first holding portion are mounted in a connector housing.

The engaging portion 73, as illustrated in FIG. 16, is constituted by a cylindrical columnar portion in the second embodiment. The engaging portion 73 is engaged with the through hole (engaged portion) 38 formed in the flat electric cable 30. Here, as illustrated in FIG. 19, the flat electric cable 30 is deflected in the deflection space BS2 and then the flat electric cable 30 is locked. The columnar portion is not limited to the cylinder.

The engaging piece 74 and the clamping pieces 75 which couple the first holding portion 70 with the housing body 41 have the same configurations as the engaging piece 54 and the clamping pieces 55 of the first embodiment. The body portion 71 and the engaging portion 73 are examples of a bypass mechanism, and deflect the flat electric cable 30, thereby bypassing an arrangement route of the flat electric cable 30 from the conductor path connecting portions 22 of the terminal fittings 20 to the lead-out portion 11.

Figure 17:
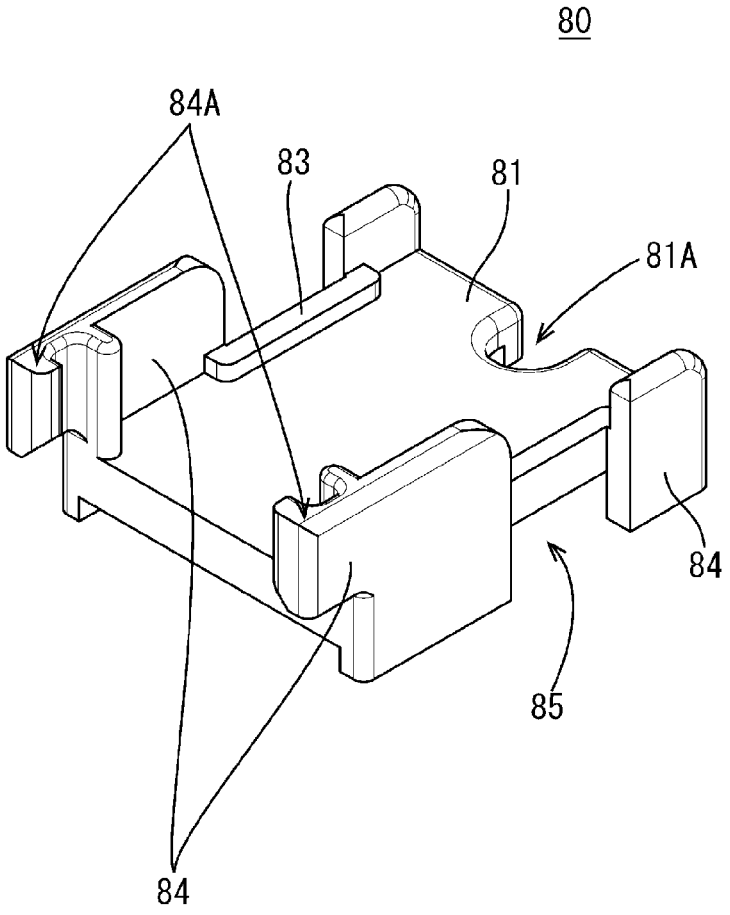
FIG. 17 is a perspective view of a second holding portion in the second embodiment.

The second holding portion 80, as illustrated in FIG. 15, is provided on the top portion of the first holding portion 70, and locked to the rear end portion of the connector housing 40. The second holding portion 80, as illustrated in FIG. 17, includes a platy portion 81, locking portions 83, and a pair of side wall portions 84.

The platy portion 81 closes the deflection space BS2 in a state where the flat electric cable 30 is deflected when the second holding portion 80 is integrated with the first holding portion 70. Here, the platy portion 81, together with the body portion 71, clamps the flat electric cable 30 on a side closer to the lead-out portion 11 than the deflection space BS2. Specifically, the flat electric cable 30 is clamped between the peripheral wall 71A of the rear portion of the body portion 71, and the platy portion 81 facing the peripheral wall 71A. At the position of the platy portion 81 corresponding to the columnar portion 73 of the first holding portion 70, an opening 81A is provided through which the columnar portion 73 passes. The platy portion 81 is an example of a bypass mechanism.

The locking portions 83 are formed on the top surface of the platy portion 81 and are locked to the claw portions 72A of the locked portions 72 of the first holding portion 70. Accordingly, the first holding portion 70 and the second holding portion 80 are coupled and integrated with each other.

A cut-out portion 85 is provided in the middle portion of each side wall portion 84, and the locked portion 72 of the first holding portion 70 is fitted to the cut-out portion 85. At the distal end portion of each side wall portion 84 at the housing body 41 side, an engage piece 84A is provided to couple the second holding portion 80 with the housing body 41. The engage piece 84A is engaged with the second engaged portion 44 of the housing body 41.

Figure 18:
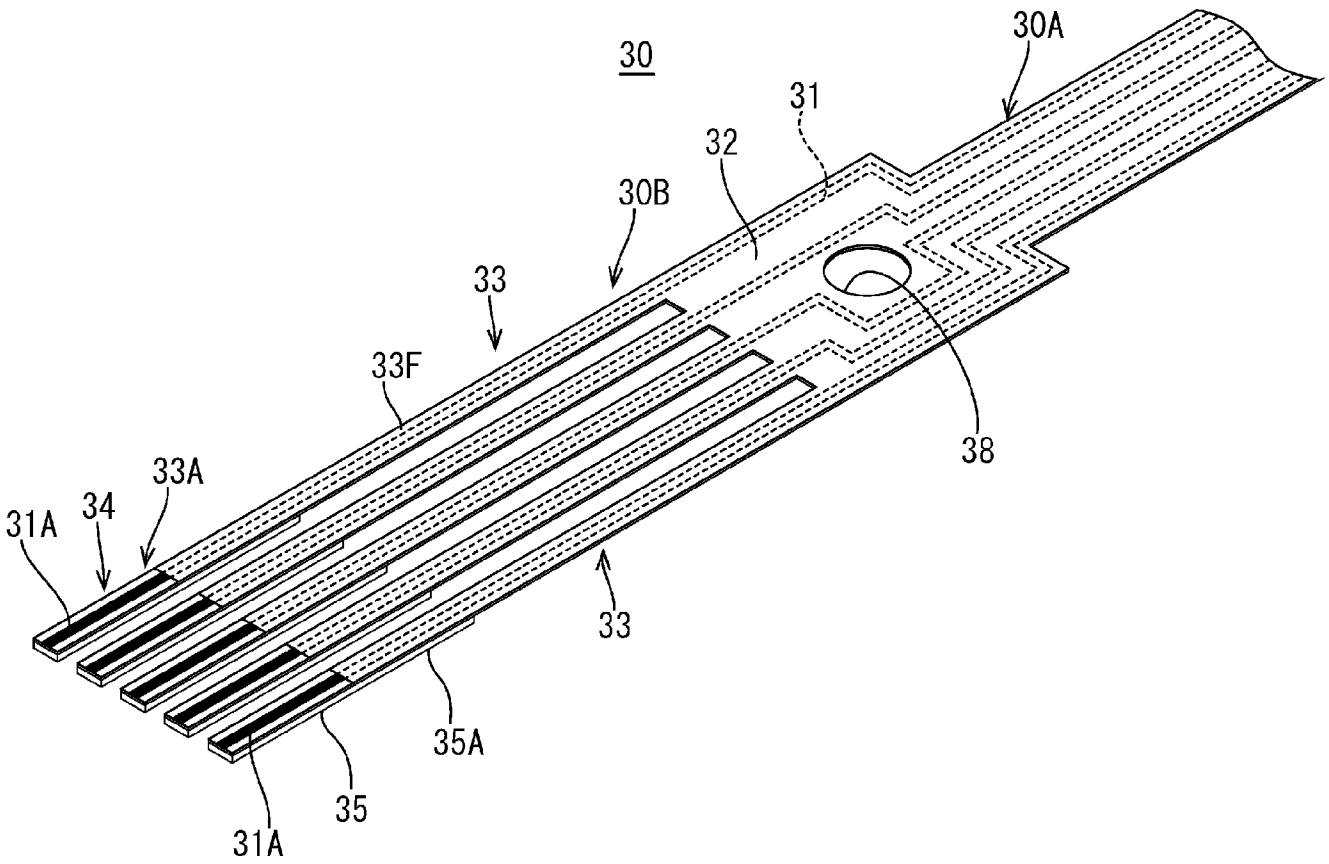
FIG. 18 is a perspective view of a flat electric cable in the second embodiment.

The flat electric cable 30 in the second embodiment, as illustrated in FIG. 18, has the through hole (an example of an engaged portion) 38 to be engaged with the columnar portion 73 of the first holding portion 70. The through hole 38, as illustrated in FIG. 19, is formed at a position on a side closer to the lead-out portion than the forming location of the deflection 37 of the flat electric cable. The columnar portion 73 passes through the through hole 38 so that the flat electric cable 30 is held by the first holding portion 70. Through this configuration, the external force is suppressed from directly acting on the deflection 37 of the flat electric cable, and thus the action of the external force on the deflection 37 of the flat electric cable can be reduced. In the flat electric cable 30, the clamping portion reinforcing plate 36 is not provided.

In a state where the first holding portion 70 is coupled and integrated with the second holding portion 80, the body portion 71 of the first holding portion 70 and the platy portion 81 of the second holding portion 80 clamp the flat electric cable at a portion extending from the through hole 38 of the flat electric cable.

4. Effect of Second Embodiment

Due to a bypass mechanism by the body portion 71 of the first holding portion 70 and the platy portion 81 of the second holding portion 80, the deflection 37 as a bypass of an arrangement route is formed in the flat electric cable 30, in the deflection space BS2. Thus, the action of the external force can be absorbed by extending the deflection 37 formed in the flat electric cable, and thus the action of the external force can be reduced. Accordingly, the external force acting on the terminal fittings 20 can be reliably reduced.

The columnar portion 73 is inserted into the through hole 38 of the flat electric cable, so that the flat electric cable 30 can be reliably held by the first holding portion 70, and the external force may be suppressed from directly acting on the deflection 37 of the flat electric cable.

A portion extending from the through hole 38 of the flat electric cable is clamped between the body portion 71 of the first holding portion and the platy portion 81 of the second holding portion. The action of the external force on the deflection in the flat electric cable is reduced due to the clamping portion, and thus, the external force acting on the terminal fittings 20 can be further reduced.

<Other Embodiments>

The present invention is not limited to the embodiments described by the above descriptions and drawings, and, for example, following embodiments may also be included in the technical scope of the present invention.

(1) In the above first embodiment, the configuration of the alleviation portion is not limited to the configuration by the first holding portion 50 illustrated in FIG. 7, and the second holding portion 60 illustrated in FIG. 8.

For example, the deflection space BS1 may not formed by the first holding portion 50 and the second holding portion 60. That is, the deflection 37 of the flat electric cable 30 may not be formed. In this case as well, the extending direction of the flat electric cable 30 may be changed by the first upper plate portion 51A and the second lower plate portion 61B so that the external force acting on the terminal fittings 20 can be further reduced.

The alleviation portions may not be separately formed as in the first holding portion 50 and the second holding portion 60, but may be integrally formed. In short, the configuration of the alleviation portion only has to include a bypass mechanism that bypasses an arrangement route of the flat electric cable 30 from the conductor path connecting portions 22 of the terminal fittings to the lead-out portion 11.

(2) In the above first embodiment, an example is described in which the clamping portion reinforcing plate 36 is provided in the flat electric cable 30, but the clamping portion reinforcing plate 36 may be omitted. Meanwhile, in the second embodiment, the clamping portion reinforcing plate 36 may be provided in a portion of the flat electric cable 30 corresponding to the vicinity of the lead-out portion 11.

(3) In the above second embodiment, the configuration of the alleviation portion is not limited to the configuration by the first holding portion 70 illustrated in FIG. 16, the second holding portion 80 illustrated in FIG. 17, and the through hole 38 illustrated in FIG. 18. For example, the through hole 38 and the columnar portion 73 of the first holding portion 70 may be omitted. An example is described in which an engaged portion of the flat electric cable 30 is set as the through hole 38, and an engaging portion of the first holding portion 70 is set as the columnar portion 73, but the present invention is not limited thereto. For example, the engaged portion of the flat electric cable 30 may be set as cut-out portions provided at both end portions in the width direction of the flat electric cable 30, and the engaging portion of the first holding portion 70 may be set as members that are engaged with the cut-out portions and fix the flat electric cable 30.

(4) In each of the above embodiments, an example is described in which the length of the distal end portion reinforcing plates 35 in the longitudinal direction is a length exposed from the connector housing 40 in a state where the terminal fittings 20 to which the band-shaped conductor paths 31A are connected are accommodated in the cavities 42, but the present invention is not limited thereto. That is, the length of the distal end portion reinforcing plates 35 in the longitudinal direction may be a length not exposed from the connector housing 40 in a state where the terminal fittings 20 are accommodated in the cavities 42.

(5) In each of the above embodiments, an example is described in which the flat electric cable 30 is constituted by an FPC, but the present invention is not limited thereto. For example, a flexible flat cable (FFC) may be employed.

(6) In each of the above embodiments, the conductor path connecting portions 22 of the terminal fittings 20 are bonded to the band-shaped conductor paths 31A by reflow solder, but the present invention is not limited thereto. The bonding may be made by laser welding or anisotropic conductive resin such as an anisotropic conductive film.

(7) In each of the above embodiments, an example is described in which the terminal fitting 20 is a so-called female type, but the present invention is not limited thereto. A male type may be employed or a round terminal (a so-called LA terminal) may be employed.

(8) In each of the above embodiments, the cavities 42 of the connector housing 40 are configured as one level, but the present invention is not limited thereto. For example, upper and lower two levels may be employed.

DESCRIPTION OF SYMBOLS

10: flat electric cable connection structure
11: lead-out portion
20: terminal fitting
22: conductor path connecting portion
30: flat electric cable (FPC)
31: strip-shaped conductor path
32: insulating resin film (insulating resin)
33: separate strip-shaped portion
36: clamping portion reinforcing plate (reinforcing plate)
38: through hole (engaged portion)
40: connector housing
42: cavity (terminal accommodation room)
50: first holding portion (alleviation portion)
51A: first upper plate portion (bypass mechanism)
51B: first lower plate portion
56: first cut-out portion (coupling portion)
60: second holding portion (alleviation portion)
61A: second upper plate portion
61B: second lower plate portion (bypass mechanism)
61C: rear wall portion (bypass mechanism)
70: first holding portion (alleviation portion)
71: body portion (bypass mechanism)
72: locked portion
73: columnar portion (engaging portion)
80: second holding portion (alleviation portion)
81: platy portion (bypass mechanism)
82: locking portion
BS1, BS2: deflection space

What is claimed is:

1. A flat electric cable connection structure comprising:

a flat electric cable including a plurality of band-shaped conductor paths wired in parallel at intervals, and an insulating resin that covers each of the band-shaped conductor paths;

a lead-out portion configured to lead out the flat electric cable to outside;

a plurality of terminal fittings individually connected to each of the band-shaped conductor paths;

a connector housing configured to accommodate the plurality of terminal fittings; and a first holding portion and a second holding portion constituting an alleviation portion provided at and locked to a rear end portion of the connector housing, and configured to alleviate an external force acting on the terminal fittings through the flat electric cable, wherein the flat electric cable includes, at one end portion thereof, a plurality of separate band-shaped portions in which the plurality of band-shaped conductor paths are individually separated, each of the separate band-shaped portions including each of the band-shaped conductor paths and the insulating resin, the terminal fittings include conductor path connecting portions, respectively, connected to the band-shaped conductor paths of the separate band-shaped portions, the alleviation portion includes a bypass mechanism configured to bypass an arrangement route of the flat electric cable from the conductor path connecting portions of the terminal fittings to the lead-out portion, the first holding portion is locked to a lower portion of the rear end portion of the connector housing, and includes:

a first upper plate portion serving as the bypass mechanism that allows the flat electric cable to be placed thereon, and changes an extending direction of the flat electric cable to a first change direction at an end portion of the extending direction of the flat electric cable;

a first lower plate portion that clamps the flat electric cable together with the second holding portion; and a coupling portion that is coupled with the second holding portion, and the second holding portion includes:

a second upper plate portion that clamps the flat electric cable together with the first upper plate portion; and a second lower plate portion serving as the bypass mechanism that changes the first change direction to a second change direction at an end portion of the first change direction, and clamps the flat electric cable in the second change direction, together with the first lower plate portion.

2. The flat electric cable connection structure of claim 1, wherein the second holding portion includes a rear wall portion serving as the bypass mechanism that forms, together with the first upper plate portion, a deflection space in which the flat electric cable is deflected.

3. The flat electric cable connection structure of claim 1, wherein the flat electric cable includes a reinforcing plate at a portion clamped between the first lower plate portion and the second lower plate portion.

* * * * *